US006406272B2

(12) United States Patent
Ruthardt et al.

(10) Patent No.: US 6,406,272 B2
(45) **Date of Patent: *Jun. 18, 2002**

(54) RADIAL PISTON PUMP FOR HIGH-PRESSURE FUEL DELIVERY

(75) Inventors: Siegfried Ruthardt, Altdorf; Rainer Haeberer, Bretten; Rainer Lorenz, Korntal-Muenchingen; Gerd Loesch, Stuttgart; Sandro Soccol, Bietigheim-Bissingen, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,656

(22) PCT Filed: Jul. 9, 1998

(86) PCT No.: PCT/DE98/01918

§ 371 (c)(1),
(2), (4) Date: Aug. 30, 1999

(87) PCT Pub. No.: WO99/02861

PCT Pub. Date: Jan. 21, 1999

(30) Foreign Application Priority Data

Jul. 11, 1997 (DE) ..... 197 29 790

(51) Int. Cl.[7] ..... F04B 1/04
(52) U.S. Cl. ..... 417/273
(58) Field of Search ..... 417/273, 454, 417/570, 571; 137/454.4, 454.5, 515.3, 540, 541, 543.19

(56) References Cited

U.S. PATENT DOCUMENTS

| | | | | | |
|---|---|---|---|---|---|
| 302,978 | A | * | 8/1884 | Brislin | 417/571 |
| 317,963 | A | * | 5/1885 | Ballantine | 417/571 |
| 319,446 | A | * | 6/1885 | Boyle | 417/571 |
| 507,901 | A | * | 10/1893 | Grist | 137/541 |
| 4,758,135 | A | * | 7/1988 | Woodward et al. | 417/559 |
| 4,813,452 | A | * | 3/1989 | Smith | 137/540 |
| 5,382,140 | A | * | 1/1995 | Eisenbacher et al. | 417/273 |

* cited by examiner

*Primary Examiner*—Charles G. Freay
(74) *Attorney, Agent, or Firm*—Ronald E. Greigg

(57) ABSTRACT

The invention relates to a radial piston pump for high-pressure fuel delivery in fuel injection systems of internal combustion engines, particularly in a common rail injection system. The pump includes a drive shaft that is supported in a pump housing and is embodied eccentrically or has a number of cam-like projections in the circumference direction. A number of pistons that are disposed radially with regard to the drive shaft are each disposed in a respective cylinder chamber and are set into a reciprocating motion in the radial direction in the cylinder chamber upon rotation of the drive shaft. Each respective cylinder chamber is sealed on the radial outside in relation to the drive shaft by a valve plate that has an intake side check valve and a high-pressure side check valve. In order to increase the efficiency of the pump, the intake side check valve has a tappet that passes through the valve plate and this tappet, on an end oriented toward the cylinder chamber has a valve disk that is placed in a sealed fashion against a sealing seat of the valve plate. On a side of the valve plate remote from the cylinder chamber, a device is provided, which pre-stresses the tappet in the closing direction.

11 Claims, 3 Drawing Sheets

RADIAL PISTON PUMP FOR HIGH-PRESSURE FUEL DELIVERY

This application is a 35 USC 371 filing based upon PCT/DE98/01918 filed Jul. 09, 1998.

PRIOR ART

The invention relates to a radial piston pump for high-pressure fuel delivery in fuel injection systems of internal combustion engines, particularly in a common rail injection system, with a drive shaft that is supported in a pump housing and is embodied as eccentric or has a number of cam-like projections in the circumference direction. The pump includes a number of pistons that are disposed radially with regard to the drive shaft, each in a respective cylinder chamber, and can be set into a reciprocating motion in the radial direction in the cylinder chamber upon rotation of the drive shaft. Each respective cylinder chamber is sealed on the radial outside with regard to the drive shaft by a valve plate that has an intake side check valve and a high-pressure side check valve.

A radial piston pump of this kind has been disclosed by DE 44 01 074 A1. The check valve is provided on a side of the valve plate oriented toward the cylinder chamber, in a diametrically enlarged section of the cylinder chamber. A valve body that can be placed against a sealing seat of the valve plate or can be lifted up from the sealing seat is contained in a basket- or cup-shaped component which extends into the cylinder chamber toward the respective piston and is fastened to the valve plate.

The valve body is pressed toward the valve plate by way of a disk spring provided at the bottom of the cup-shaped component.

Based on this known radial piston pump, an object of the current invention is to improve its efficiency.

In a radial piston pump of the type mentioned above, this object is attained according to the invention by virtue of the fact that the intake side check valve has a tappet that passes through the valve plate and this tappet, on its end oriented toward the cylinder chamber, has a valve disk that can be placed in a sealed fashion against a sealing seat of the valve plate. On a side of the valve plate remote from the cylinder chamber, a device is provided which pre-stresses the tappet in the closing direction.

In this manner, the dead space that defines the piston stroke, i.e. the structural space of the intake side check valve, is significantly reduced. In the known radial piston pump, the stroke of the pump piston was defined by the outside of the cup-shaped component. Now, during the compression phase, the piston can extend at least almost to the outside of the valve disk of the check valve, i.e. even into the stroke region of the valve disk of the check valve. The dead volume is thus minimal and the efficiency of the radial piston pump is greater than in the previously known pump.

In a preferred embodiment of the radial piston pump according to the invention, the device that pre-stresses the tappet in the closing direction includes a spring, which is supported on one end against the side of the valve plate remote from the cylinder chamber and is supported on the other end against a counter support provided on the tappet.

The disposition of the device, which pre-stresses the tappet in the closing direction, on the side of the valve plate remote from the cylinder chamber brings with it the advantage that the device can be embodied in an intrinsically arbitrary manner so that it supplies a desired opening pressure for the check valve.

The counter support for the spring can be realized in an intrinsically arbitrary manner; for example, an axial stop can be provided on the tappet, e.g. by means of upsetting or notching. In a preferable manner and according to a variant of the invention, the counter support is constituted by a collared bushing element whose bushing section concentrically encompasses the tappet and whose collar section supports the spring. This opens up the possibility of sliding the counter support onto the tappet and fixing it in the desired location.

The fixing of the counter support can take place in an intrinsically arbitrary manner. However, it has turned out to be advantageous if the counter support is attached to the tappet in a positively engaging manner, particularly by means of a crimping work cycle.

In order to preset the opening pressure of the check valve, a spring can be chosen that has particular dimensions or a particular spring constant. However, in order to be able to flexibly preset the opening pressure in the manufacture of radial piston pumps without having to resort to a multitude of various valve springs, which have to be kept on hand for this purpose, the proposal is made to fix the counter support in a position on the tappet such that the desired opening pressure of the check valve is produced. In particular, a counter support in the form of the above-mentioned collar bushing element has turned out to be advantageous for this purpose.

However, it can also turn out to be advantageous if the counter support is constituted by a disk- or plate-shaped component that rests against an axial stop on the tappet, for example a slit securing disk or the like that can be snapped onto the tappet. In such a case, axial stops can be provided at various axial positions on the tappet. However, it may turn out to be more advantageous to provide an axial stop, for example in the form of a circumferentially extending annular groove, and to keep securing disks of various thicknesses on hand and to use them depending on the opening pressure required. The thickness of a securing disk can be determined easily, and the selection during the assembly of the check valve is therefore easy.

In order to be able to optimally employ the structural space on the side of the valve plate remote from the cylinder chamber, it has turned out to be advantageous if at least one opening that is essentially radial to the longitudinal direction of the cylinder chamber is provided in the valve plate and communicates with a fuel supply opening in the housing. According to this concept of the invention, the fuel supply therefore does not occur from the radial outside with regard to the drive shaft, but rather fuel is supplied by way of an opening that extends in the plane of the valve plate. This radial opening then preferably feeds into the tappet through opening of the valve plate.

Other features, details, and advantages of the invention ensue from the graphic depiction and subsequent description of preferred embodiments of the invention.

DETAILED OF THE DRAWINGS

Figure 1:
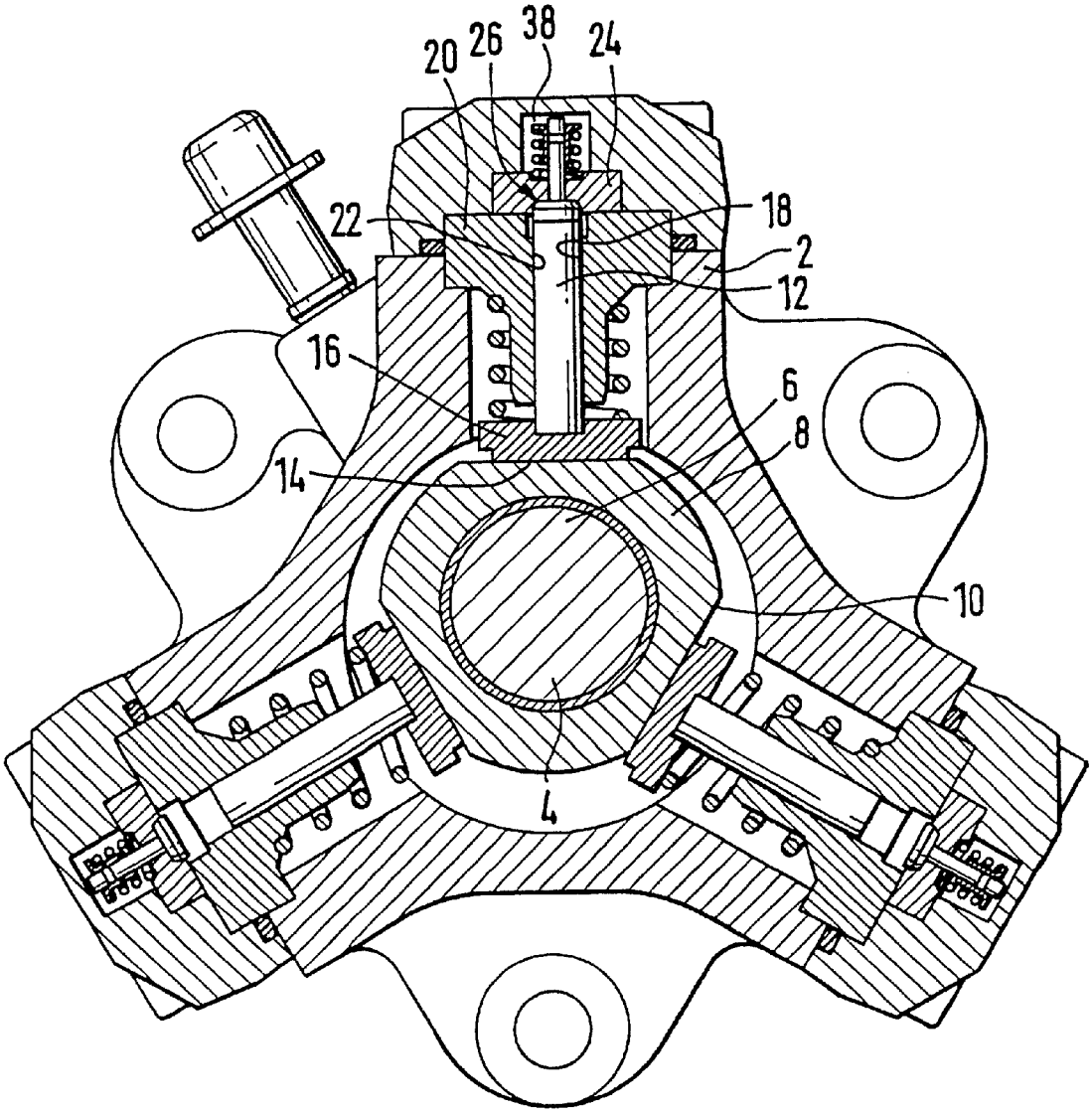
FIG. 1 is a sectional view of a radial piston pump according to the invention.
Figure 2:
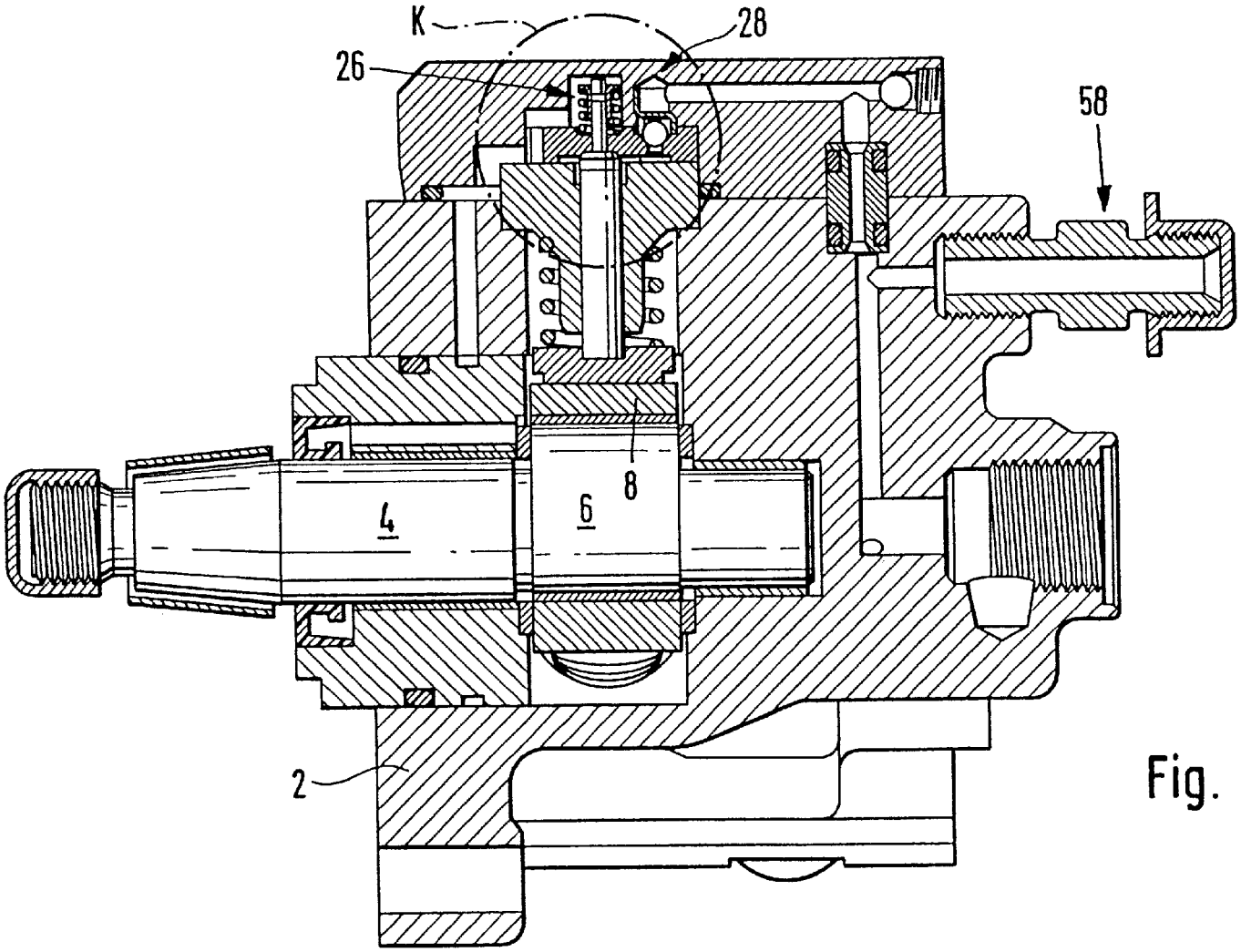
FIG. 2 is a sectional view of plane II—II in FIG. 1.

FIGS. 1 and 2 show a radial piston pump for high-pressure fuel delivery in fuel injection systems of internal combustion engines. The radial piston pump includes a component 2, which constitutes a housing, in which a drive shaft 4, which has an eccentric shaft section 6, is rotatably supported by bearing components that can be seen in the drawing. A slide bushing 8 is provided, which encompasses the eccentric shaft section 6, and the eccentric shaft section 6 rotates in this slide bushing 8. On its circumference, the slide bushing 8 has 3 flattenings 10 that are offset from one another by 120°, against each of which a respective piston 12 rests with an intermediary pressure piece 16 that has a flat contact surface 14.

Each respective piston 12 is supported so that it can carry out a reciprocating motion in a cylinder chamber 18 in the radial direction in relation to the drive shaft 4. The cylinder chamber 18 is constituted by a bearing component 20 that is inserted into housing component 2 in the radial direction in relation to the drive shaft 4, wherein this bearing component 20 has a through opening 22 for this purpose.

Figure 3:
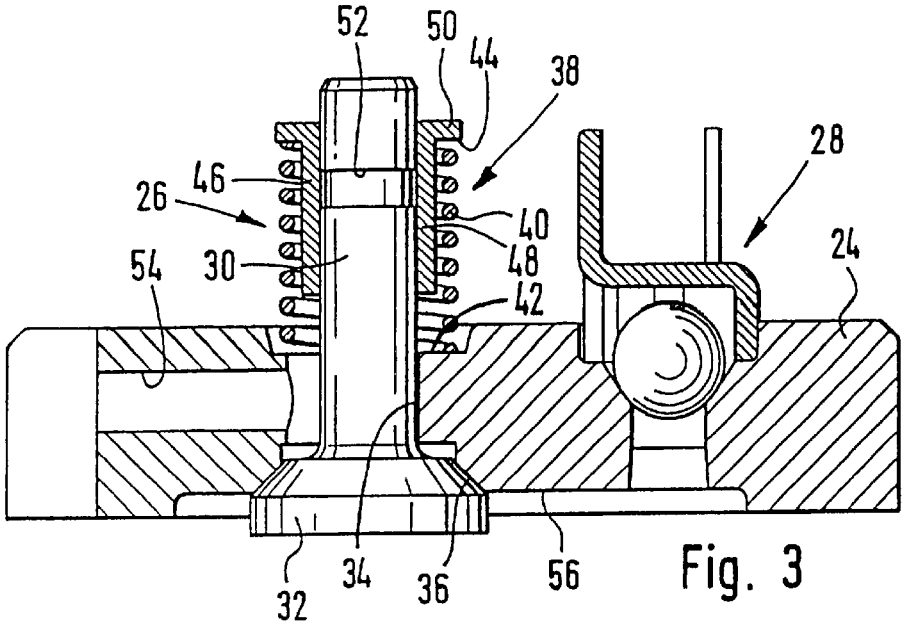
FIG. 3 is a sectional view of a valve plate with a check valve, in an embodiment that is related to, but deviates slightly from the one in the radial piston pump according to FIGS. 1 and 2.

The end of the through opening 22 that is on the radial outside in relation to the drive shaft 4 is sealed by a valve plate 24 that is shown in detail in FIG. 3, which rests flat against the radially outer end of the bearing component 20. An intake side check valve that is indicated as a whole with the reference numeral 26 and a high-pressure side check valve 28 are integrated into the valve plate 24. The intake side check valve 26 includes a tappet 30; which has a valve disk 32 on its end oriented toward the cylinder chamber 18 and extends through a through opening 34 in the valve plate 24. The valve disk 32 can be pressed in a sealed fashion against a sealing seat 36 on the side of the valve plate 24 oriented toward the cylinder chamber 18. On the opposite side of the valve plate 24, a device is provided, which is labeled as a whole with the reference numeral 38 and is for pre-stressing the tappet 30 in the closing direction of the valve. The device 38 includes a valve spring 40, which concentrically encompasses the tappet 30 and is supported on one end against a recess 42 in the valve plate 24 and is supported on the other end against a counter support 44 provided on the tappet 30. The counter support 44 is constituted by a collar bushing element 46 whose bushing section 48 concentrically encompasses the tappet 30 and whose collar section supports the spring 40.

In order to assemble the intake side check valve 26, the tappet 30 is inserted from the side of the valve plate 24 closest to the cylinder chamber, through the opening 34 until the valve disk 32 rests in a sealed fashion against the valve seat 36. Then the spring 40 is slid onto the tappet 30 from the opposite end. Finally, the collar bushing element 48 is slid onto the tappet 30 inside the spring 40 until the restoring force of the spring 40 produces a desired resistance that defines the opening pressure of the check valve. The collar bushing element 48 is fastened in this position on the tappet 30, e.g. by means of a crimping work cycle, wherein the bushing section 48 of the collar bushing element 46 is deformed into a radial circumferential groove 52 of the tappet 30.

As can be further inferred from FIG. 3, in contrast to the depiction of FIGS. 1 and 2, in FIG. 3, an opening 54 that extends in the plane of the plate is provided for the supply of fuel. The opening 54 feeds into the tappet through opening 34 of the valve plate 24. With the intake stroke of the piston 12, the tappet 30 or the valve disk 32 is lifted up from the sealing seat 36 counter to the initial stress of the spring 40 so that fuel is conveyed past the valve disk 32 and can be aspirated into the cylinder chamber 18 by way of the supply opening 54. With the subsequent compression stroke, the intake side check valve 26 closes and the piston 12 can extend with its piston face until it almost reaches the valve disk 32 of the intake side check valve 26. The high-pressure fuel then travels by way of a recess 56 to the high-pressure side check valve 28 and from there, to a high-pressure outlet fitting 58 of the radial piston pump.

Figure 4:
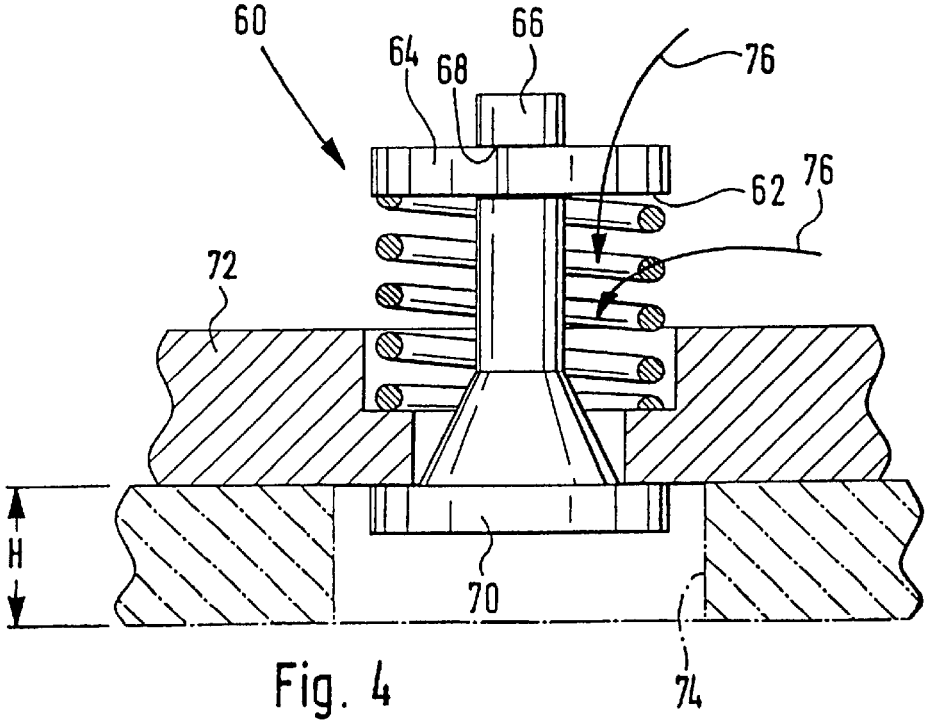
FIG. 4 shows another embodiment of a valve plate with a intake side check valve.

FIG. 4 shows another embodiment of an intake side check valve 60 that differs from the embodiment described above essentially by virtue of the fact that the counter support 62 is constituted by a slit securing disk 64 that can be clipped onto the tappet 66 in the region of an annular groove 68 that extends in the circumference direction. Since the annular groove 68 and the axial stop are provided on the tappet 66, the desired opening pressure of the check valve is adjusted through the selection of a securing disk 64 of a particular thickness d.

From FIG. 4 it is also clear that a large part of the stroke H of the tappet 66 or the valve disk 70 can be utilized for the compression stroke of the pump piston.

In the instance depicted, the fuel delivery does not occur by means of an opening in the plane of the valve plate 72, but (in accordance with FIGS. 1 and 2) from the side of the valve plate 62 remote from the cylinder chamber 74, as indicated by the arrows 76.

The foregoing relates to a preferred exemplary embodiment of the invention, it being understood that other variants and embodiments thereof are possible within the spirit and scope of the invention, the latter being defined by the appended claims.

What is claimed is:

1. A radial piston pump for high-pressure fuel delivery in fuel injection systems of internal combustion engines comprising a common rail injection system, said pump comprises a drive shaft (4) that is supported in a pump housing (2) and includes an eccentric shaft section (6) in the circumference direction, a number of pistons (12) that are disposed radially with regard to the eccentric shaft section (6) of the drive shaft (4), each piston in a respective cylinder chamber (18, 74), each piston is set into a reciprocating motion in a radial direction in the cylinder chamber (18, 74) due to the eccentric shaft section (6) upon rotation of the drive shaft (4), wherein each respective cylinder chamber (18, 74) is sealed on the radial outside in relation to the eccentric shaft section (6) of the drive shaft (4) by a one piece valve plate (24, 72) that has an intake side first check valve (26, 60) and a high-pressure side second check valve (28), the intake side first check valve (26, 60) has a tappet (30, 66) that passes through the valve plate (24, 72) and this tappet, on an end oriented toward the cylinder chamber (18, 74), has a valve disk (32, 70) that is placed in a sealed fashion against a sealing seat (36) of the valve plate (24, 72), and that on a side of the valve plate (24, 72) remote from the cylinder chamber (18, 74), a device (38) is provided, which pre-stresses the tappet (30, 66) in a closing direction, wherein the device (38) that pre-stresses the tappet (30, 66) in the closing direction includes a spring (40) that is supported on one end against a side of the valve plate (24, 72) remote from the cylinder chamber (18, 74) and is supported on another end against a counter support (44, 62) provided on the tappet (30, 66), and the counter support (44, 62) is attached to the tappet (30, 66) in a positively engaging manner, by means of crimping.

2. The radial piston pump according to claim 1, in which the counter support (44) is constituted by a collar bushing element (46) whose bushing section (48) concentrically encompasses the tappet (30) and whose collar section (50) supports the spring (40).

3. The radial piston pump according to claim 1, in which the counter support (44) is fixed in a position on the tappet (30) such that a pre-selected opening pressure of the check valve (26) is produced.

4. The radial piston pump according to claim 2, in which the counter support (44) is fixed in a position on the tappet (30) such that a pre-selected opening pressure of the first check valve (26) is produced.

5. The radial piston pump according to claim 1, in which at least one opening (54) is provided in the valve plate (24) and this opening is aligned essentially radial to a longitudinal direction of the cylinder chamber (18) and communicates with a fuel supply opening.

6. The radial piston pump according to claim 2, in which at least one opening (54) is provided in the valve plate (24) and this opening is aligned essentially radial to a longitudinal direction of the cylinder chamber (18) and communicates with a fuel supply opening.

7. The radial piston pump according to claim 5, in which the radial opening (54) feeds into the tappet through a second opening (34) of the valve plate (24).

8. A radial piston pump for high-pressure fuel delivery in fuel injection systems of internal combustion engines comprising a common rail injection system, said pump comprises a drive shaft (4) that is supported in a pump housing (2) and includes an eccentric shaft section (6) in the circumference direction, a number of pistons (12) that are disposed radially with regard to the eccentric shaft section (6) of the drive shaft (4), each piston in a respective cylinder chamber (18, 74), each piston is set into a reciprocating motion in a radial direction in the cylinder chamber (18, 74) due to the eccentric shaft section (6) upon rotation of the drive shaft (4), wherein each respective cylinder chamber (18, 74) is sealed on the radial outside in relation to the eccentric shaft section (6) of the drive shaft (4) by a one piece valve plate (24, 72) that has an intake side first check valve (26, 60) and a high-pressure side second check valve (28), the intake side first check valve (26, 60) has a tappet (30, 66) that passes through the valve plate (24, 72) and this tappet, on an end oriented toward the cylinder chamber (18, 74), has a valve disk (32, 70) that is placed in a sealed fashion against a sealing seat (36) of the valve plate (24, 72), and that on a side of the valve plate (24, 72) remote from the cylinder chamber (18, 74), a device (38) is provided, which pre-stresses the tappet (30, 66) in a closing direction, wherein the device (38) that pre-stresses the tappet (30, 66) in the closing direction includes a spring (40) that is supported on one end against a side of the valve plate (24, 72) remote from the cylinder chamber (18, 74) and is supported on another end against a counter support (44, 62) provided on the tappet (30, 66), and the counter support (62) is constituted by a slit disk (64) that rests against an axial stop (68) which is part of the tappet (66).

9. The radial piston pump according to claim 8, in which at least one opening (54) is provided in the valve plate (24) and this opening is aligned essentially radial to a longitudinal direction of the cylinder chamber (18) and communicates with a fuel supply opening.

10. The radial piston pump according to claim 9, in which the radial opening (54) feeds into the tappet through opening (34) of the valve plate (24).

11. The radial piston pump according to claim 8 in which the counter support (44) is fixed in a position on the tappet (30) such that a pre-selected opening pressure of the check valve (26) is produced.

* * * * *